US008066209B2

(12) United States Patent
Abramson et al.

(10) Patent No.: US 8,066,209 B2
(45) Date of Patent: Nov. 29, 2011

(54) SHREDDER HEAD ADAPTED TO SHRED DATA BEARING DOCUMENTS AND BOTTLES

(76) Inventors: Aron Abramson, Brooklyn, NY (US); Charles Sued, Brooklyn, NY (US)

( * ) Notice: Subject to any disclaimer, the term of this patent is extended or adjusted under 35 U.S.C. 154(b) by 0 days.

(21) Appl. No.: 12/887,717

(22) Filed: Sep. 22, 2010

(65) Prior Publication Data

US 2011/0011962 A1 Jan. 20, 2011

Related U.S. Application Data

(62) Division of application No. 11/861,645, filed on Sep. 26, 2007, now Pat. No. 7,819,351.

(51) Int. Cl.
*B02C 19/00* (2006.01)
*B02C 25/00* (2006.01)

(52) U.S. Cl. ..... 241/30; 241/99

(58) Field of Classification Search ..... 241/30, 241/24.22, 24.3, 99, 100, 285.2, 285.3, 24.21, 241/24.23, 242
See application file for complete search history.

(56) References Cited

U.S. PATENT DOCUMENTS

| | | | | |
|---|---|---|---|---|
| 4,379,525 | A * | 4/1983 | Nowicki et al. | 241/20 |
| 4,923,126 | A * | 5/1990 | Lodovico et al. | 241/30 |
| 5,076,505 | A * | 12/1991 | Petrocy | 241/99 |
| 5,186,331 | A * | 2/1993 | Valster | 209/3.1 |
| 5,215,265 | A * | 6/1993 | Lodovico | 241/99 |
| 5,328,106 | A * | 7/1994 | Griffin, Jr. | 241/99 |
| 5,484,109 | A * | 1/1996 | Cook | 241/73 |
| 5,833,151 | A * | 11/1998 | Doak | 241/37.5 |
| 6,988,683 | B2 * | 1/2006 | Whettingsteel | 241/79 |
| 7,556,213 | B2 * | 7/2009 | Schwelling | 241/99 |
| 2006/0108461 | A1 * | 5/2006 | Waldron | 241/99 |

* cited by examiner

*Primary Examiner* — Faye Francis
(74) *Attorney, Agent, or Firm* — Garcia-Zamor IP Law; Ruy M. Garcia-Zamor

(57) ABSTRACT

A shredder head adapted to shred data bearing documents and bottles.

16 Claims, 5 Drawing Sheets

SHREDDER HEAD ADAPTED TO SHRED DATA BEARING DOCUMENTS AND BOTTLES

CROSS REFERENCE TO RELATED APPLICATIONS

This application is a divisional of, claims priority to and benefit of U.S. Patent application Ser. No. 11/861,645, filed Sep. 26, 2007, now U.S. Pat. No. 7,819,351, which is hereby incorporated by reference herein as if fully set forth in its entirety.

BACKGROUND

The present invention is generally directed to shredders and, more specifically, to a shredder adapted to shred data bearing documents and bottles.

Conventional shredders shred office documents, receipts, credit cards, CDs, DVDs, and the like to protect personal information from third parties. However, personal data is often located on bottles, such as prescription bottles, that cannot be disposed of using conventional shredders.

It would be advantageous to provide a shredder that can also shred bottles and a method of doing the same.

SUMMARY

Briefly speaking, one embodiment of the present invention is directed to a shredder head adapted to shred data bearing documents and bottles. The shredder head includes a shredder head housing including a housing section that is moveable between first and second housing section positions. When the housing section is in the first housing section position the shredder head is adapted to receive data bearing documents to be shredded. When the housing section is in the second housing section position, a volume is defined within the housing section that is adapted to contain a bottle for shredding. A plurality of shredder blades are disposed within the shredder head housing and are adapted to shred material inserted therein.

In a separate aspect, one embodiment of the present invention is directed to a shredder head adapted to shred data bearing documents and bottles. The shredder head includes a shredder head housing that defines a slot. The shredder head housing being configurable to orient the slot in first and second slot configurations. When the shredder head housing is configured so that the slot is oriented in the first slot configuration the shredder head is adapted to receive data bearing documents to be shredded. When the shredder head housing is configured so that the slot is oriented in the second slot configuration the shredder head is adapted to receive a bottle for shredding. A plurality of shredder blades are disposed within the shredder head housing and adapted to shred material inserted in the slot.

In a separate embodiment, one embodiment of the present invention is directed to a shredder head adapted to shred data bearing documents and bottles. The shredder head including a shredder head housing defining a slot therein. A plurality of shredder blades are disposed within the shredder head housing and adapted to shred material inserted therein. The shredder head housing is configurable to shred data bearing documents and bottles.

In a separate embodiment, one embodiment of the present invention is directed to a method of shredding material. The method including the steps of: providing a shredder defining at least one slot for receiving material. The shredder including a plurality of shredder blades adapted to shred the material inserted into the at least one slot. The shredder being configurable to shred data bearing documents and bottles.

BRIEF DESCRIPTION OF THE DRAWINGS

The foregoing summary, as well as the following detailed description of the preferred embodiment of the present invention will be better understood when read in conjunction with the appended drawings. For the purpose of illustrating the invention, there are shown in the drawings an embodiment which is presently preferred. It is understood, however, that the invention is not limited to the precise arrangements and instrumentalities shown. In the drawings.

DETAILED DESCRIPTION OF THE PREFERRED EMBODIMENTS

Figure 1:
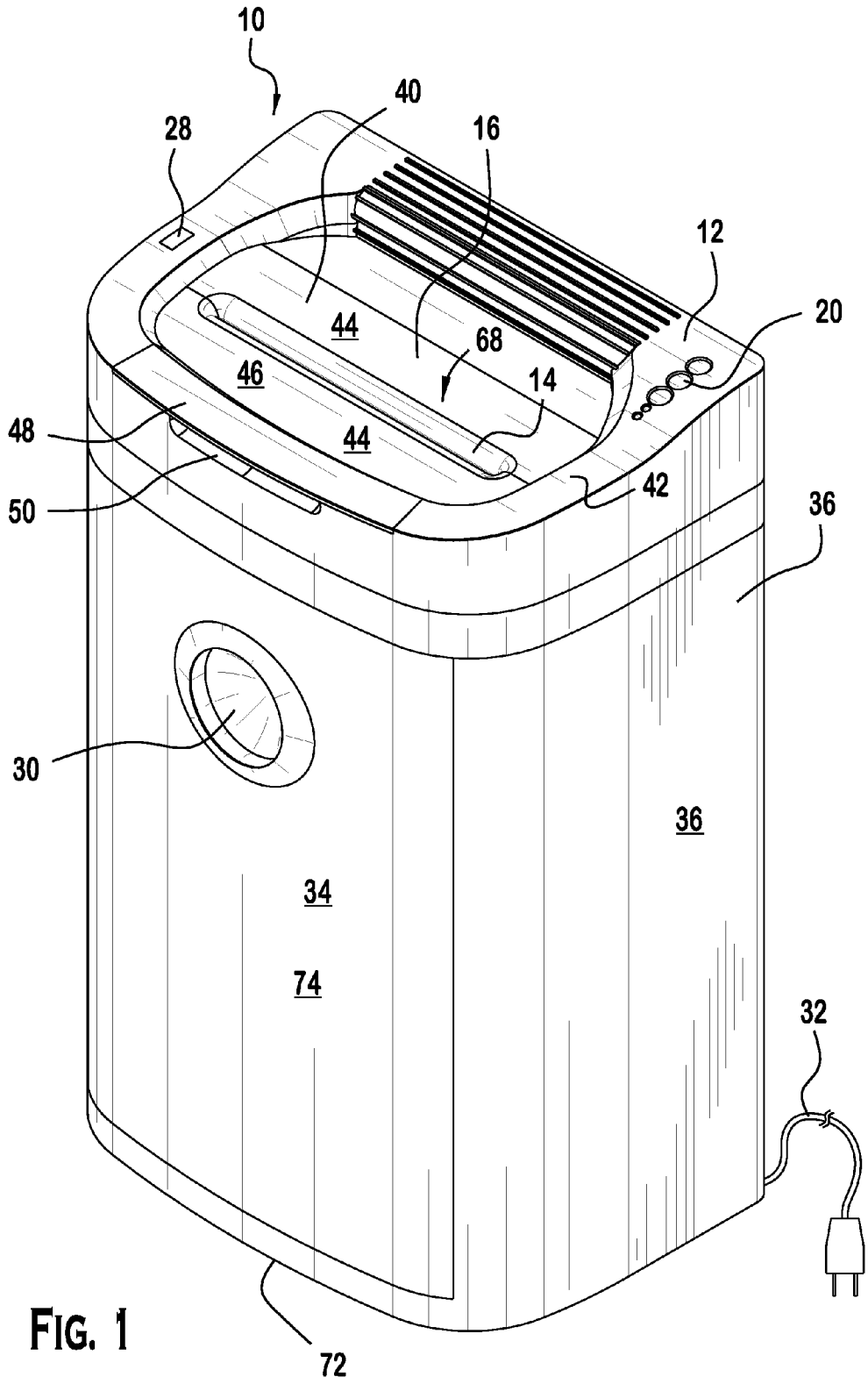
FIG. 1 is a perspective view of a shredder according to the preferred embodiment of the present invention; A housing section defines a slot for receiving material to be shredded; The housing section is moveable between first and second housing positions and is shown in the first housing section position; A selectable control and/or biometric control is located on the shredder head.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The term "data bearing documents", as used in the claims and in corresponding portions of the specification, means "any of articles, paper, documents, office papers, envelopes, receipts, credit cards, identification cards, banking cards, CDs, DVDs, or the like". The term "activated" as used with shredder blades means that the blades are moved in whatever manner results in shredding (i.e., that the blades 18 are operating for shredding). Similarly, the term "deactivated" when used with shredder blades means that the shredder blades are operating for shredding purposes. The term "selectable control", as used in the claims and the corresponding portions of the specification, means "any one of a physical switch, a touch switch, a button, a biometric control, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The term "biometric selectable control", as used in the claims and in the corresponding portions of the specification, means "any controller that is activated upon detection of specific biometric information via fingerprint scanning, palm scanning, voice recognition, facial recognition, retinal scanning, and the like." The language "at least one of 'A', 'B', and 'C'," as used in the claims and in corresponding portions of the specification, means "any group having at least one 'A'; or any group having at least one 'B'; or any group having at least one 'C'; —and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-5, wherein like numerals indicate like elements throughout, there is shown a preferred embodiment of a shredder 10 adapted to shred data bearing documents and bottles. Briefly speaking, the shredder 10 includes a shredder head housing 12 defining a slot 14 therein. A plurality of shredder blades 18 are disposed within the shredder head housing 12 and are adapted to shred material inserted therein. The shredder head housing 12 is configurable to shred data bearing documents and bottles. The shredding of bottles, such as prescription bottles or the like, is very advantageous since they often have confidential information printed thereon. The shredder head 10 of the present invention is preferably of the type used in homes, home offices, and offices to shred materials bearing confidential data.

While the preferred shredder head housing 12 has a generally rectilinear shape, those of ordinary skill in the art will appreciate from this disclosure that the shredder head housing 12 can have any shape without departing from the scope of the present invention. The shredder head may also include a bin full indicator 20 or other operational indicators and/or controls. Shredder head handles may be located on the left and right lateral sides of the shredder head housing 12 to allow easy lifting of the shredder head from the shredder basket 34.

The shredder 10 can have a shredder head housing 12 that is placed directly on the shredder basket 34 or similar waste can. Alternatively, a shredder housing 36 may extend generally downwardly from the shredder head housing 12 to slidably receive the shredder basket 34.

The shredder preferably receives power from an outlet via a power conduit, such as an electrical cord, 32. However, the shredder can be powered by batteries or any other suitable power source.

Figure 2:
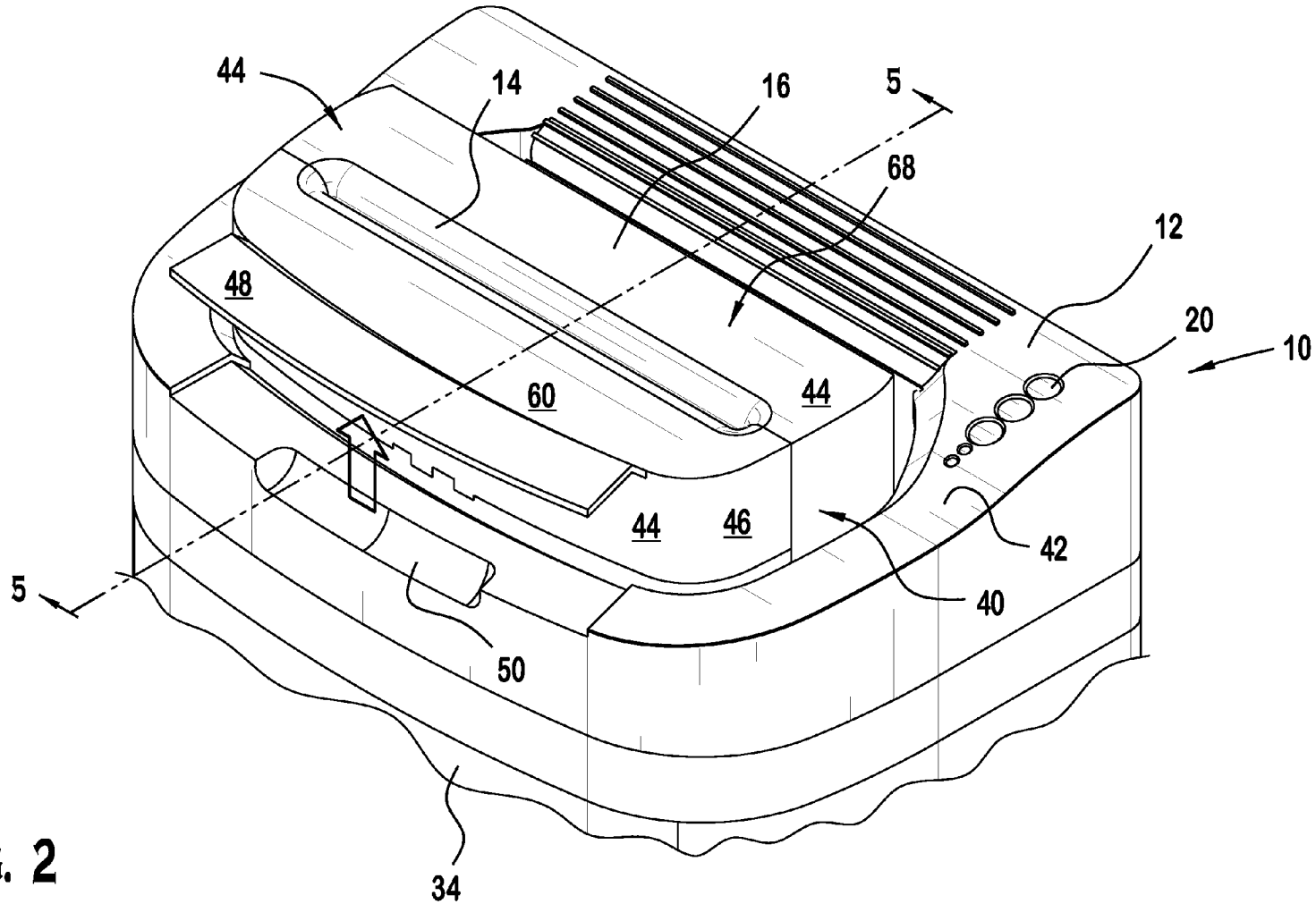
FIG. 2 is a partial, enlarged view of the shredder of FIG. 1 illustrating the housing section in the second housing section position; The housing section is preferably formed by an enclosure that is vertically moveable relative to a remainder of the shredder head housing.

Referring to FIGS. 1 and 2, one preferred embodiment of the shredder head 10 of the present invention includes a shredder head housing 12. The shredder head housing 12 includes at least one slot 14 for inserting material (such as data bearing documents, bottles, or the like) to be shredded. The primary slot 14 guides material to be shredded to shredder blades 18 that are driven by a motor 24 located in the shredder head housing 12. The plurality of shredder blades 18 are disposed within the shredder head housing 12 and are adapted to shred material inserted into the slot 14.

The shredder head housing 12 preferably includes a housing section 40 that is moveable between first and second housing section positions. FIG. 1 illustrates the housing section 40 in the first housing section position and FIG. 2 illustrates the housing section 40 in the second housing section position. The housing section 40 may define the slot 14 and can include an enclosure 44 that is adapted for vertical movement relative to the remainder 42 of the shredder head housing 12.

Figure 3:
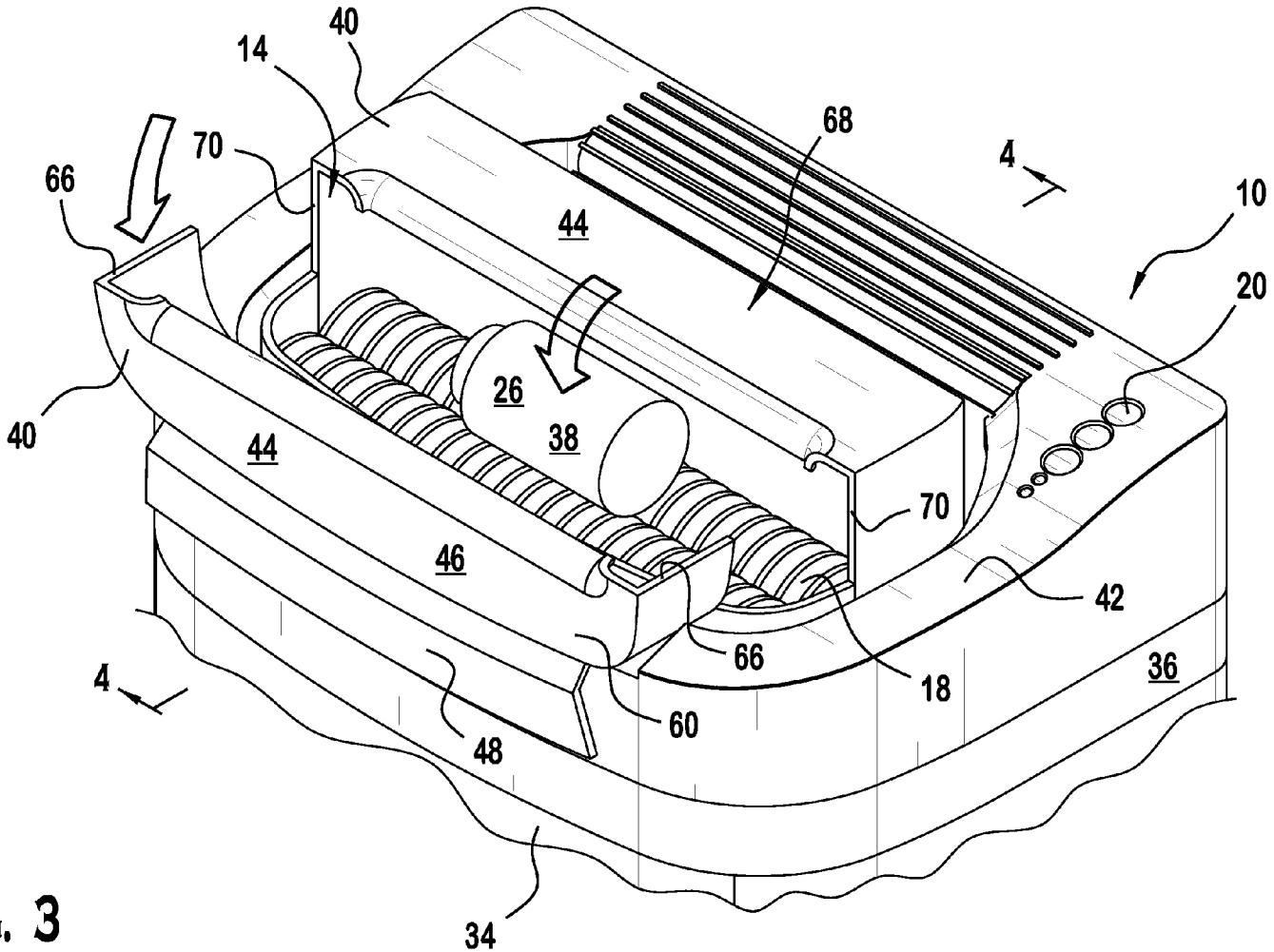
FIG. 3 is a partial enlarged view of the shredder of FIG. 1 illustrating the housing section in the second housing section position; The enclosure includes an enclosure panel that is moveable between first and second enclosure panel positions; The housing section is in the second housing section position and the enclosure panel is in the second enclosure panel position such that the shredder head is configured to receive a bottle for shredding.

Referring to FIGS. 2 and 3, the enclosure 44 preferably includes an enclosure panel 46 that defines at least a portion of the slot 14 and is moveable between first and second enclosure panel positions. When the enclosure panel 46 is in the first enclosure panel position (shown in FIG. 2) the housing section 40 is configured such that the slot 14 is oriented in a first slot configuration and the slot 14 is adapted to receive data bearing documents. When the enclosure panel 46 is in the second enclosure panel position (shown in FIG. 3) the housing section 40 is configured such that the slot 14 is oriented in the second slot configuration and the slot 14 is adapted to receive bottles. While one preferred construction of the housing section 40 and various slot configurations have been described, those of ordinary skill in the art will appreciate from this disclosure that any method of modifying the shredder head housing 12 to accommodate bottles and any method of adjusting the slot configuration to accommodate bottles 38 may be used without departing from the scope of the present invention.

Figure 5:
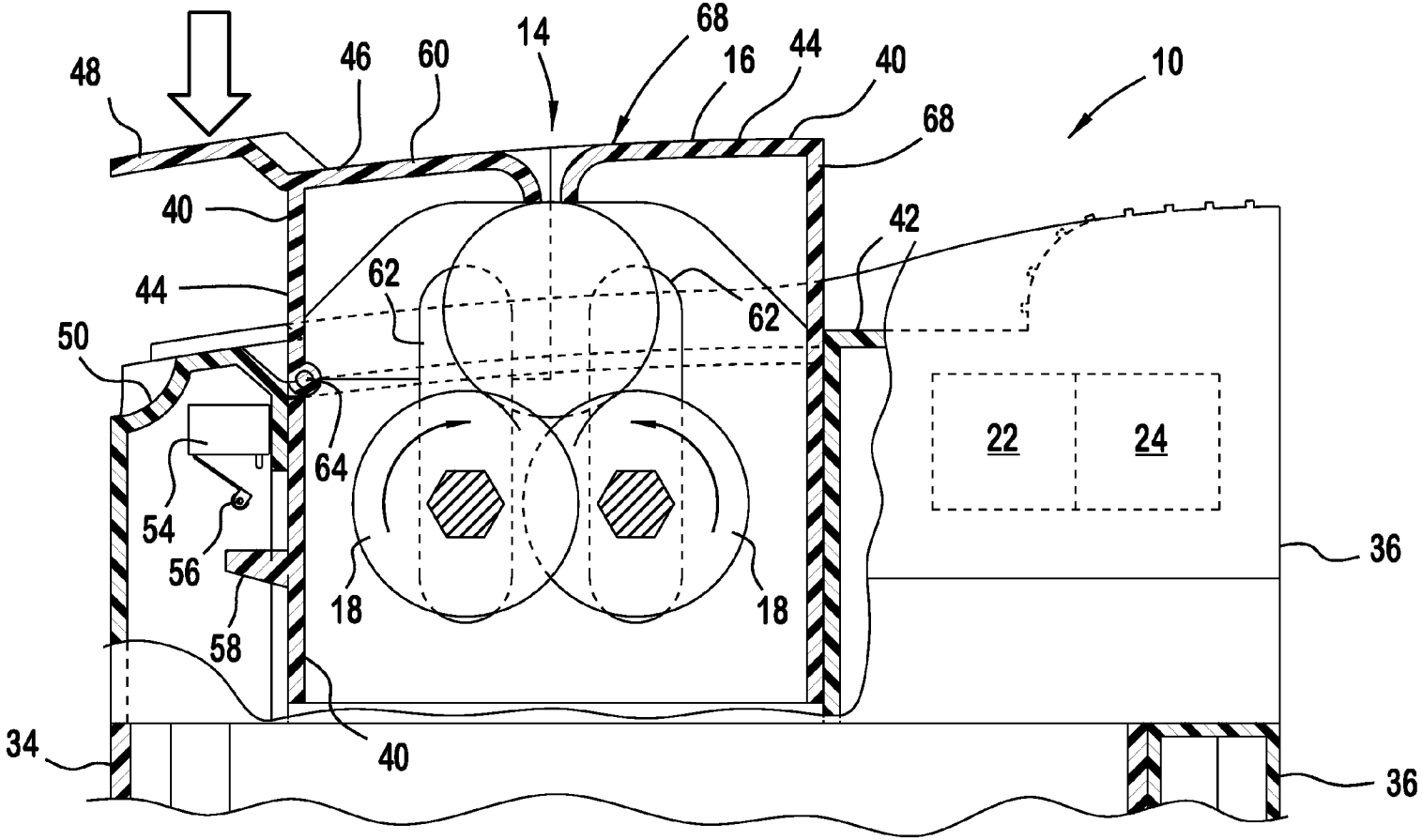
FIG. 5 is a cross-sectional view of the shredder of FIG. 2 as taken along the line 5-5 in FIG. 2 illustrating the volume that may be defined by the housing section when the housing section is in the second housing section position; The volume is preferably adapted to contain a bottle to be shredded; Once a bottle is position in the volume, it is preferred that the enclosure panel is returned to the first enclosure panel position and that the flange is used to push the housing section generally downwardly to facilitate shredding the bottle.

As best shown in FIGS. 2 and 5, a flange 48 may be located on the enclosure panel 46 and extend therefrom. The flange 48 can be configured to facilitate rotation of the enclosure panel 46 and to facilitate the application of force onto the enclosure 44 in a general direction of the remainder 42 of the shredder head housing 12. A groove is preferably located on the top 16 of the shredder head housing 12 below the flange 48 to make it easy to grasp the flange 48 when the housing section 40 is in the first housing section position. As shown in FIG. 5, the enclosure 44 is preferably configured to facilitate the pushing of the bottle 38 (or other material 26) past the plurality of shredder blades 18 after the bottle 38 is inserted into the enclosure 44 and the enclosure panel 46 is moved into the first enclosure panel position.

When the housing section 40 is in the first housing section position (shown in FIG. 1), the shredder head 10 is adapted to receive data bearing documents to be shredded. When the housing section 40 is in the second housing section position (shown in FIGS. 2 and 5) a volume is defined within the housing section 40 that is adapted to contain the bottle 38 for shredding.

Figure 4:
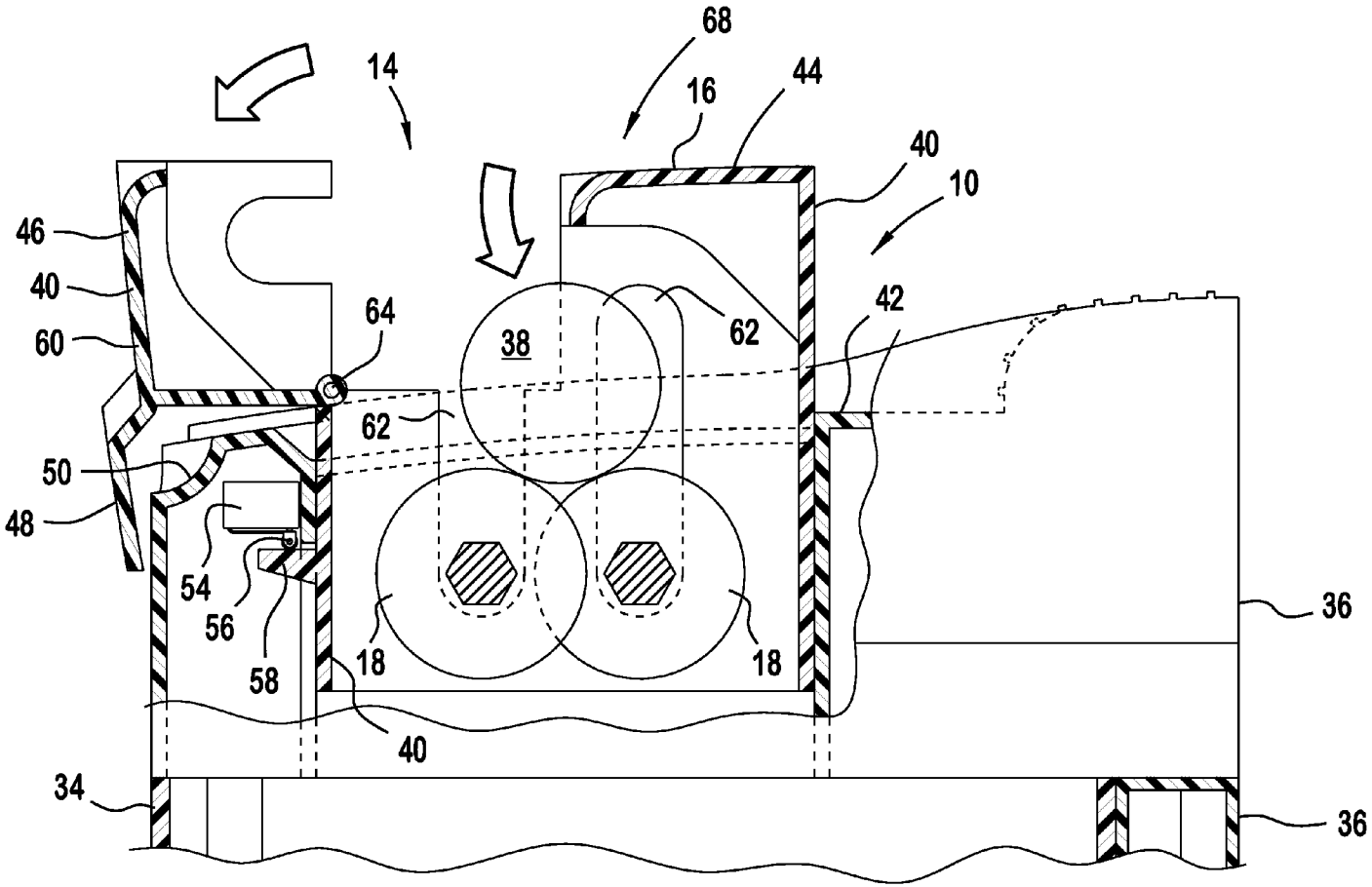
FIG. 4 is a cross-sectional view of the shredder of FIG. 3 as taken along the line 4-4 in FIG. 3; Guides slots are present in the enclosure to allow the enclosure to at least partially cover the shredder blades and to allow the enclosure to slide thereover; A flange is attached to the enclosure panel to facilitate rotation of the enclosure panel and to facilitate the application of force onto the enclosure in a general direction of the remainder of the shredder head housing; It is preferred that the lower left side of the enclosure include an abutment positioned thereon and projecting generally outwardly therefrom; The shredder head may include a sensor and a prong; The abutment may depress the prong to activate the sensor when the housing section is in the second housing position.

Referring to FIG. 1, the shredder head housing 12 defines a slot 14. The shredder head housing 12 is preferably configurable to orient the slot 14 in first and second slot configurations (as shown in FIGS. 1 and 4, respectively). Those of ordinary skill in the art will appreciate from this disclosure that any other suitable slot configurations can be used without departing from the scope of the present invention. When the shredder head housing 12 is configured so that the slot 14 is in the first slot configuration, the shredder head is adapted to receive data bearing documents. When the shredder head housing 12 is configured so that the slot 14 is in the second slot configuration, the shredder head 10 is adapted to receive bottles 38 for shredding. While the preferred embodiment of the shredder head 12 incorporates a vertically adjustable housing section, those of ordinary skill in the art will appreciate from this disclosure that any other shredder head design that allows for the insertion of bottles can be used without departing from the scope of the present invention.

Referring to FIGS. 4 and 5, the housing section 40 preferably includes an abutment 58 positioned thereon and projecting generally outwardly therefrom. The shredder head 10 can also include a sensor 54 and a contact prong 56. It is preferred that the abutment 58 is configured to depress the contact prong 56 and activate the sensor 54 when the housing section 40 is in the second housing section position. The sensor is preferably in communication with a controller 22 that causes a motor 24 to deactivate the shredder blades 18 when the sensor 54 is activated. The shredder blades 18 are disposed within the shredder head housing 12 and are adapted to shred material inserted therein.

Referring to FIG. 4, the enclosure 44 preferably includes at least one guide slot 62 therethrough to allow the enclosure 44 to at least partially cover the plurality of shredder blades 18 and to slide thereover. It is preferred that four slots 62 are located in the enclosure 44 so that the drive shafts for the shredder blades 18 can be maintained in position while the housing section 40 is vertically adjusted.

The shredder 10 may include a controller 22 that is in communication with a motor 46 in the shredder and various sensors and controls. The controller 22 is preferably in communication with the shredder head 10 and prevents operation of the shredder blades 18 once the housing section 40 moved from the first housing section position until the enclosure panel 46 has been moved out of the first enclosure panel position and then returned to the first enclosure panel position. Similarly, the controller 22 may prevent operation of the shredder blades 18 while the enclosure panel 46 is in the second enclosure panel position or the controller 22 may prevent the operation of the shredder blades 18 when the shredder head 12 is configured so that the slot 14 is oriented in the second slot configureation.

As best shown in FIGS. 1 and 5, the shredder head 10 may be used with a shredder basket 34 that has a housing 36 and an opening located proximate the shredder head housing 12 and is adapted to receive the material 26 shredded by the plurality of shredder blades 18. However, those of ordinary skill in the art will appreciate from this disclosure that the shredder head 10 can be used with any type of receptacle or shredder basket without departing from the scope of the present invention.

Referring to FIG. 1, the shredder 10 preferably includes a selectable control 28, such as a biometric switch, that is in communication with the shredder 10 and prevents movement of the housing section 40 from the first housing section position until the selectable control is activated. Similarly, the control 18, may prevent the shredder housing 12 from being configured such that the slot 14 is removed from the first slot configuration until the control is activated. One non limiting example of a suitable biometric sensor is the MBF Solid State Fingerprint Sensor manufactured by Fujitsu. Details regarding one possible construction of a fingerprint sensor is set forth in U.S. Pat. No. 7,235,853, entitled "Fingerprint Detection Device and Method of its Manufacture, and Apparatus for Forming a Protective Film", which issued on Jun. 26, 2007, and which is hereby incorporated by reference in its entirety as if fully set forth herein. While two examples of biometric sensors have been mentioned, those of ordinary skill in the art will appreciate that any suitable biometric sensor 28 can be used with the shredder 10 of the present invention without departing from the scope of the present invention. For example, the biometric sensor 28 can be configured for fingerprint recognition, palm recognition, voice recognition, facial recognition, retinal scanning, temperature recognition, or for detection of any suitable biometric parameter. The biometric sensor 28 is in communication with the shredder 10 and is adapted to detect predetermined biometric information. The biometric sensor can be configured to accept predetermined biometric information that includes multiple users or a single user without departing from the scope of the present invention.

The present invention also a method of shredding material. One preferred method of the present invention will be described in conjunction with various preferred embodiments of the shredder 10. The steps of the method of the present invention can be performed in any order, omitted, or combined without departing from the scope of the present invention. As such, optional steps described in conjunction with one method can also be used or omitted. Additionally, unless otherwise stated, similar components described in conjunction with the method preferably, but not necessarily, operate in a generally similar manner to that described elsewhere in this application.

The first preferred method of shredding material, includes: providing a shredder that defines at least one slot 14 for receiving material. The shredder includes a plurality of shredder blades 18 adapted to shred material 26, 38 inserted into the at least one slot 14. The shredder is configurable to shred data bearing documents and bottles 38. While a preferred shredder configuration has been described above, those of ordinary skill in the art will appreciate that any shredder configuration that allows for the shredding of both data bearing documents and bottles (preferably prescription bottles 38) can be used without departing from the scope of the present invention. The method may include adjusting the volume enclosed by the shredder head housing 12 to allow for the placement of a bottle 38 therein. Enlarging the slot 14 to allow the insertion of a bottle 38 into the shredder head 10 may also form part of the method. The activation of the shredder blades 18 may prevented while a bottle 38 is being inserted through the slot 14.

The method may include adjusting at least a portion of the shredder head housing 12 to form an enclosure 44 for receiving a bottle 38 for shredding. The insertion of a bottle 38 into the shredder may be prevented until a selectable control is activated (which may be a biometric control). The detection of biometric data by the shredder head 10 may be required prior to allowing the insertion of a bottle 38 therein.

One preferred embodiment of the present invention operates as follows. Referring to FIG. 1, a user may activate the selectable/biometric control 28 to allow the housing section 40 to be moved out of the first housing section position. Then a user inserts a portion of his or her hand into the groove 50 beneath flange 48 and lifts the housing section generally upwardly. Referring to FIGS. 2 and 3, once the housing section 40 is in the second housing section position, the flange 48 is used to rotate the enclosure panel 46 about hinge 64 to orient the slot 14 to receive a bottle 38 therethrough. Referring to FIGS. 3 and 4, once the bottle is inserted into the enclosure 44, the enclosure panel is rotated into the first enclosure panel position (as shown in FIG. 5) to contain the bottle 38 in a volume defined by the enclosure 44. Then, the flange 48 can be depressed to press the bottle 38 against the shredder blades 18 for shredding. While the movement of the housing section 40, enclosure 44, and enclosure panel 46 has been described as manually driven, those of ordinary skill in the art will appreciate from this disclosure that such movements can be automated without departing from the scope of the present invention.

It is recognized by those skilled in the art that changes may be made to the above described method and/or shredder head 10 without departing from the broad inventive concept thereof. For example any other suitable shredder configuration that allows for the shredding of bottles can be used without departing from the scope of the present invention. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A method of shredding material, comprising:

providing a shredder defining at least one slot for receiving material, the shredder comprising a plurality of shredder blades adapted to shred the material inserted into the at least one slot; the shredder being configurable to shred data bearing documents and bottles; and adjusting the volume enclosed by a shredder head housing and thereby increasing the distance between the plurality of shredder blades and a portion of the top side of the shredder head housing generally above the plurality of shredder blades to allow for the placement of a bottle therein.

2. The method of claim 1, further comprising preventing the activation of the shredder blades while a bottle is being inserted through the slot.

3. The method of claim 1, further comprising adjusting at least a portion of the shredder head housing to form an enclosure for receiving a bottle for shredding.

4. The method of claim 1, further comprising preventing the insertion of a bottle into the shredder head until a selectable control has been activated.

5. The method of claim 1, further comprising preventing the insertion of a bottle into the shredder head until a selectable control has been activated.

6. The method of claim 1, further comprising requiring the detection of biometric data by the shredder head prior to allowing the insertion of a bottle therein.

7. The method of claim 1, wherein the step of providing a shredder further comprises a shredder for use in an office.

8. The method of claim 1, wherein the step of providing a shredder further comprises a shredder for use in a home.

9. A method of shredding material, comprising:

providing a shredder defining at least one slot for receiving material, the shredder comprising a plurality of shredder blades adapted to shred the material inserted into the at least one slot; the shredder being configurable to shred data bearing documents and bottles; and enlarging the slot and thereby increasing the distance between the plurality of shredder blades and a portion of the top side of a shredder head housing generally above the plurality of shredder blades to allow for the placement of a bottle therein.

10. The method of claim 9, further comprising preventing the activation of the shredder blades while a bottle is being inserted through the slot.

11. The method of claim 9, further comprising adjusting at least a portion of the shredder head housing to form an enclosure for receiving a bottle for shredding.

12. The method of claim 9, further comprising preventing the insertion of a bottle into the shredder head until a selectable control has been activated.

13. The method of claim 9, further comprising preventing the insertion of a bottle into the shredder head until a selectable control has been activated.

14. The method of claim 9, further comprising requiring the detection of biometric data by the shredder head prior to allowing the insertion of a bottle therein.

15. The method of claim 9, wherein the step of providing a shredder further comprises a shredder for use in an office.

16. The method of claim 1, wherein the step of providing a shredder further comprises a shredder for use in a home.

* * * * *